United States Patent [19]

Boswell et al.

[11] Patent Number: 4,790,581

[45] Date of Patent: Dec. 13, 1988

[54] SAFETY DOOR LATCH

[76] Inventors: Walter H. Boswell, 913 Coleman Dr.; Richard D. Hibbard, 315 Penniman Rd., both of Williamsburg, Va. 23185

[21] Appl. No.: 91,046

[22] Filed: Aug. 28, 1987

[51] Int. Cl.[4] ..... E05C 17/36

[52] U.S. Cl. ..... 292/264; 292/262; 292/DIG. 65

[58] Field of Search ..... 292/264, 262, 263, DIG. 65; 70/93

[56] References Cited

U.S. PATENT DOCUMENTS

| | | | |
|---|---|---|---|
| 1,329,723 | 2/1920 | Muennich | 292/264 |
| 3,087,751 | 4/1963 | Nisenbaum et al. | 292/264 |
| 3,802,726 | 4/1974 | Galbreath et al. | 292/DIG. 65 X |
| 4,296,957 | 10/1981 | Belles | 292/264 |
| 4,472,143 | 9/1984 | Bennett et al. | 292/264 X |

FOREIGN PATENT DOCUMENTS

| | | | |
|---|---|---|---|
| 17912 | of 1904 | United Kingdom | 292/264 |

*Primary Examiner*—Lloyd A. Gall
*Assistant Examiner*—Curtis B. Brueske
*Attorney, Agent, or Firm*—George F. Helfrich

[57] ABSTRACT

A safety door latch, which can be simply and quickly disengaged in the event of an emergency, has an elongated keeper plate, which is secured to the inside of the stile of a door in proximity to the edge of the stile and substantially perpendicular thereto. An elongated slide, which is received by and releasably retained within the keeper plate, has an elongated slot therein for releasably securing a chain thereto. The proximal end of the slide is positioned within the keeper plate near the edge of the stile, and the distal end of the slide, which terminates in a clasp, is positioned within the keeper plate away from the edge of the stile. A chain is anchored at one end thereof to the striker jamb of the door and has a pin secured to the other end thereof for insertion into the slot and releasable retainment therein.

2 Claims, 1 Drawing Sheet

FIGURE 3A
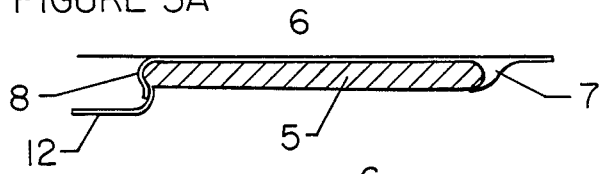
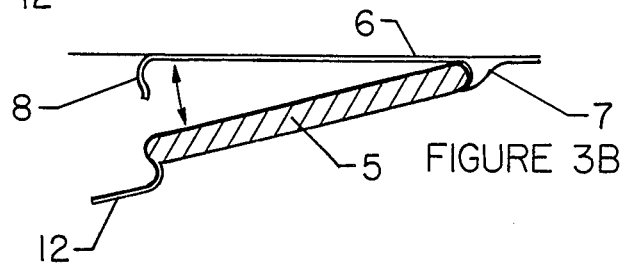
FIGURE 3B
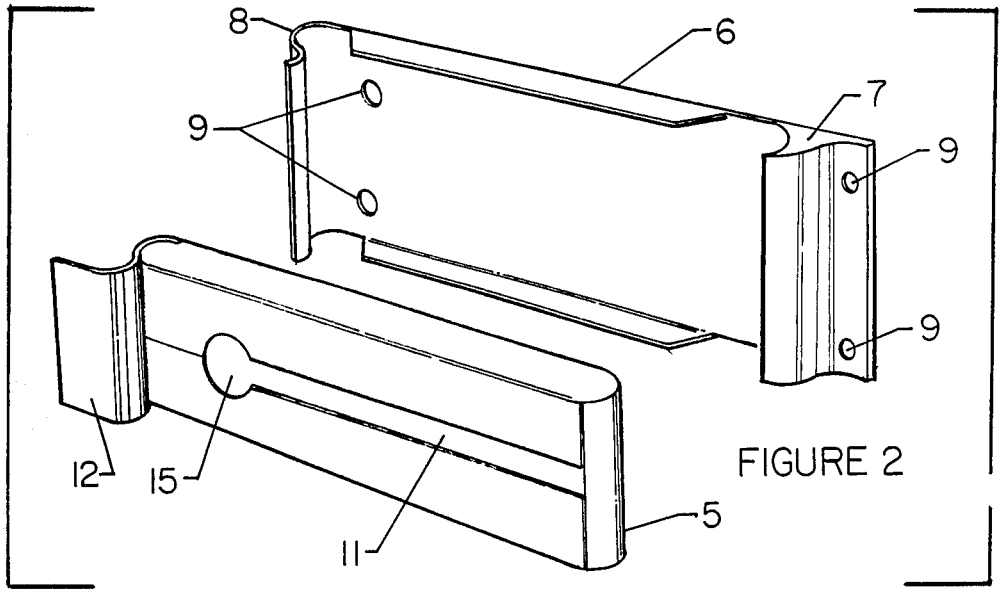
FIGURE 2
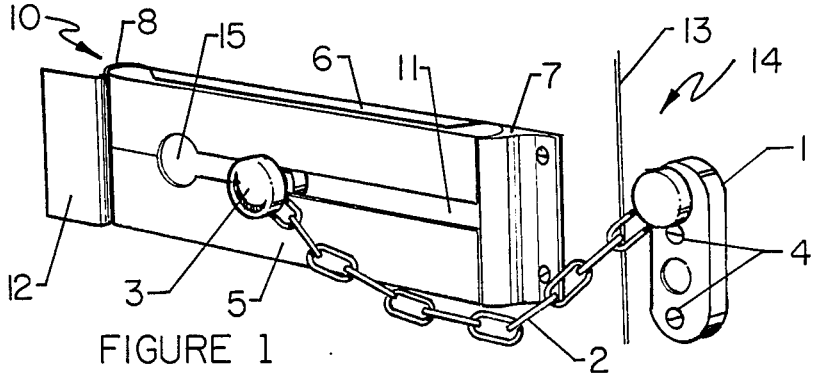
FIGURE 1

SAFETY DOOR LATCH

BACKGROUND OF THE INVENTION

1. Field of the Invention

This invention relates generally to door fasteners. It relates particularly to a chain-type safety door latch which can be simply and quickly disengaged in the event of an emergency.

2. Prior Art

Numerous attempts have been made over the years to provide a safety door latch to prevent unlawful and undesired entry into dwellings, hotel rooms, and the like, and a number of devices are currently available on the market for purchase and use by the public. Notwithstanding the efficacy of these devices, they are all found wanting in one most important aspect, viz., they are not simply and quickly disengagable in the event of a fire or other emergency. That is to say, safety is provided by preventing unwanted entry into a room, but safety is not provided in the case of a hurried egress from the room, as in an emergency brought about by fire, unexpected illness, accident, etc. In particular, the safety chain, which keeps the intruder out, also keeps the occupant in, as it cannot be simply and quickly disengaged (especially by the elderly and the infirm) during a time of crisis.

The closest art known to applicants, viz., U.S. Pat. Nos. 4,472,153 and 4,296,957, will not obviate the problem, as the complicated devices disclosed therein do not provide for quick and simple disengagement of the safety latch, in order to allow rapid egress.

SUMMARY OF THE INVENTION

It is accordingly the primary object of the present invention to provide what has been unavailable in the prior art, viz., a safety door latch of the chain type which can be simply and quickly disengaged, even by the elderly and the infirm, in the event of a crisis requiring rapid egress.

This primary object, as well as other related objects and associated benefits, is achieved by the provision of a device which has an elongated keeper plate, which is secured to the inside of the stile of a door in proximity to the edge of the stile, with the longitudinal axis of the keeper plate being substantially perpendicular to the edge of the stile. Also provided is an elongated slide, adapted to be received by and releasably retained within the keeper plate. The slide has an elongated slot therein for releasably securing a chain thereto. The proximal end of the slide is positioned within the keeper plate near the edge of the stile. The distal end of the slide, which terminates in a clasp, is positioned within the keeper plate away from the edge of the stile. A chain having anchor means secured on one end thereof for anchoring the chain to the striker jamb of the door, has a pin secured to its other end for insertion into the slot in the slide and releasable retainment therein.

In a preferred embodiment, the slide is received by and releasably retained within the keeper plate by spring tension applied by the keeper plate on the slide.

The very best results are obtained in the making and using of the present invention when spring tension is applied by the keeper plate on the slide by means of a spring lip located at the distal end of the keeper plate in cooperation with a safety lip located at the proximal end of the keeper plate.

BRIEF DESCRIPTION OF THE DRAWINGS

For a more complete understanding of the present invention, including its primary object and benefits, reference should be made to the Detailed Description set forth below. This Detailed Description should be read together with the accompanying drawings, wherein:

FIG. 1 is a perspective view showing a preferred embodiment of the present invention as installed on a door;

FIG. 2 is an exploded perspective showing the arrangement and positioning of the essential elements slide 5 and keeper plate 6; and FIG. 3 is a schematic which shows how spring lip 8 and safety lip 7 of keeper plate 6 cooperate to apply spring tension on slide 5, and how slide 5 is removed from keeper plate 6.

DETAILED DESCRIPTION OF THE PREFERRED EMBODIMENTS

Referring now to the drawings, FIG. 1 shows a preferred embodiment 10 of the present invention as installed on a door. Elongated keeper plate 6 is secured to the inside of the stile of a door in proximity to edge 13 of the stile, with the longitudinal axis of keeper plate 6 being substantially perpendicular to edge 13 of the stile. Keeper plate 6, which is secured to the stile by means of screws passing through mounting holes 9 and seen in FIG. 2, is fabricated from any of a number of strong, rigid materials of construction, with stainless steel being preferred. Elongated slide 5 is adapted to be received by and releasably retained within keeper plate 6 (FIGS. 1 and 2). Slide 5, which is fabricated from any of a number of strong, rigid materials of construction with stainless steel being preferred, has elongated slot 11 therein for releasably securing chain 2 thereto. The end of slide 5 which is proximal to edge 13 of the stile is referred to as its proximal end, and is positioned within keeper plate 6 so that it is held in place by means of safety lip 7. The end of keeper plate 6 which terminates in safety lip 7 is referred to as the proximal end of keeper plate 6. The distal end of slide 5, which terminates in clasp 12, is held in place within keeper plate 6 by means of spring lip 8 at the distal end thereof. Chain 2 has anchor means 1 on one end thereof for anchoring chain 2 to the striker jamb 14 of a door, as by screws 4. At the opposite end of chain 2 there is secured a pin 3 for insertion through hole 15 into slot 11 and releasable retainment therein. Under normal conditions safety door latch 10 may be released by moving pin 3 along slot 11 to hole 15, and then removing pin 3 therefrom.

However, under abnormal conditions, such as those in a crisis or an emergency, it is difficult (especially for the old and the infirm) to move pin 3 along slot 11 to hole 15 and then remove it therefrom. This is especially true if the door has been opened, as by one so anxious to leave the room. Under these conditions, safety latch 10 may be simply and quickly disengaged by pulling upon clasp 12, whereupon slide 5 is removed—along with pin 3 and chain 2—from keeper plate 6, thereby allowing immediate egress from the room. The removal of slide 5 from keeper plate 6 by a pulling motion exerted on clasp 12 is shown schematically in FIGS. 3A and B. Moreover, FIGS. 3A and B, along with FIG. 1 reveal that spring tension applied by keeper plate 6, especially by the cooperation of safety lip 7 and spring lip 8, provides the releasable retainment of slide 5 within keeper plate 6. Moreover, as is understood by those of skill in the art, safety lip 7, which is located at the proximal end of keeper plate 6, presents a protective fixture which withstands the removal force applied by pin 3 of chain 2 upon slide 5 when safety door latch 10 is operating to prevent entry into the room from outside.

The present invention has been described in detail with respect to certain preferred embodiments thereof. As is understood by those of skill in the art, variations and modifications in this detail may be made without any departure from the spirit and scope of the present invention, as defined in the hereto-appended claims.

What is claimed is:

1. A safety door latch which can be simply and quickly disengaged in the event of an emergency, the safety door latch comprising:

an elongated keeper plate which is secured to the inside of the stile of a door in proximity to the edge of the stile, the longitudinal axis of the keeper plate being substantially perpendicular to the edge of the stile;

an elongated slide adapted to be received by and releasably retained within the keeper plate, the slide having an elongated slot therein for releasably securing a chain thereto, the slide having a proximal end and a distal end, the proximal end positioned within the keeper plate near the edge of the stile, and the distal end positioned within the keeper plate away from the edge of the stile and terminating in a clasp, the slide being received by and releasably retained within the keeper plate by spring tension applied by the keeper plate on the slide; and a chain having anchor means secured on one end thereof for anchoring the chain to the striker jamb of the door, and a pin secured to the other end of the chain for insertion into the slot in the slide and releasable retainment therein.

2. The device of claim 1, wherein the spring tension is applied by the keeper plate on the slide by means of a spring lip located at the distal end of the keeper plate in cooperation with a safety lip located at the proximal end of the keeper plate.

* * * * *